United States Patent [19]

Luhman et al.

[11] 4,052,240

[45] Oct. 4, 1977

[54] TAPING DEVICE AND METHOD OF TAPING

[75] Inventors: Robert A. Luhman, Cylon Township, St. Croix County, Wis.; John R. Ward, St. Paul, Minn.

[73] Assignee: Minnesota Mining and Manufacturing Company, St. Paul, Minn.

[21] Appl. No.: 682,100

[22] Filed: Apr. 30, 1976

[51] Int. Cl.[2] ..... B31B 1/72

[52] U.S. Cl. ..... 156/212; 93/36.9; 156/250; 156/482; 156/486; 156/492; 156/510; 156/580

[58] Field of Search ..... 156/202, 204, 212, 213, 156/216, 226, 227, 468, 475, 477 R, 478, 479, 480, 482, 484, 485, 486, 489, 492, 250, 510, 580; 93/36.9

[56] References Cited

U.S. PATENT DOCUMENTS

| | | | |
|---|---|---|---|
| 2,643,016 | 6/1953 | Steckling | 156/468 |
| 2,653,727 | 9/1953 | Wagner et al. | 156/468 |
| 3,079,977 | 3/1963 | Larkin | 156/477 R |
| 3,284,982 | 11/1966 | Conti | 156/485 |
| 3,546,045 | 12/1970 | Califano et al. | 156/477 |
| 3,915,786 | 10/1975 | Collett et al. | 156/482 |

*Primary Examiner*—Charles E. Van Horn
*Assistant Examiner*—Basil J. Lewris
*Attorney, Agent, or Firm*—Cruzan Alexander; Donald M. Sell; William L. Huebsch

[57] ABSTRACT

An improved box taping device of the type which propels a box past a tape applying head. The device includes means for holding a portion of the tape transverse of the box path so that it will engage the leading surface of the box and subsequently be applied along the top surface of the box as the box is propelled through the device. The device also includes means adapted to extend a U-shaped length of the tape along the trailing surface of the box after the box is taped along its top surface. During such movement one extended portion of the U-shaped length of tape is adhered to the trailing surface of the box. The extended portions of the U-shaped length of tape are separated after they extend entirely across the path and the portion not adhered to the box is retained in that position transverse of the path so that the device is ready to tape another box moved along the path.

4 Claims, 8 Drawing Figures

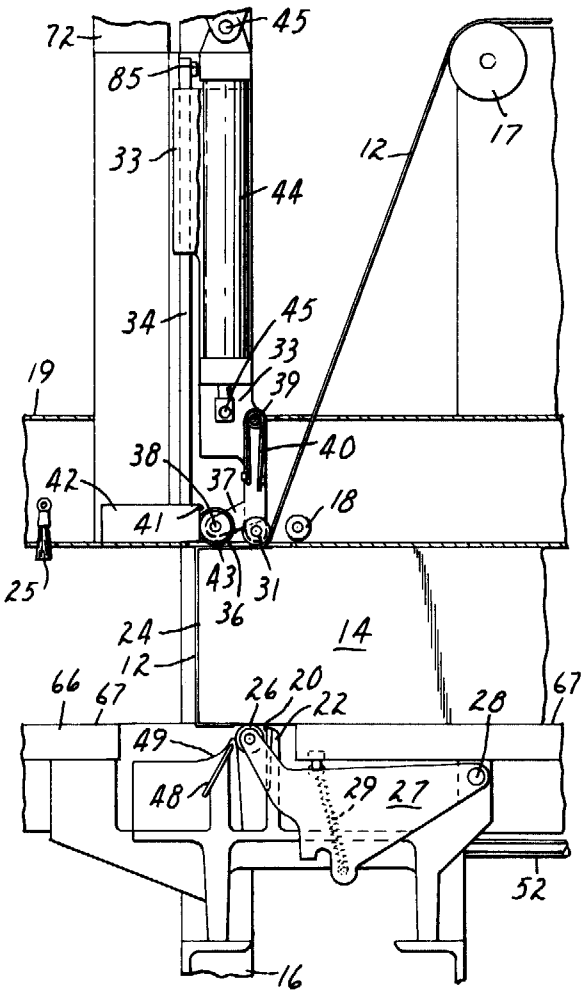
FIG. 4
FIG. 8
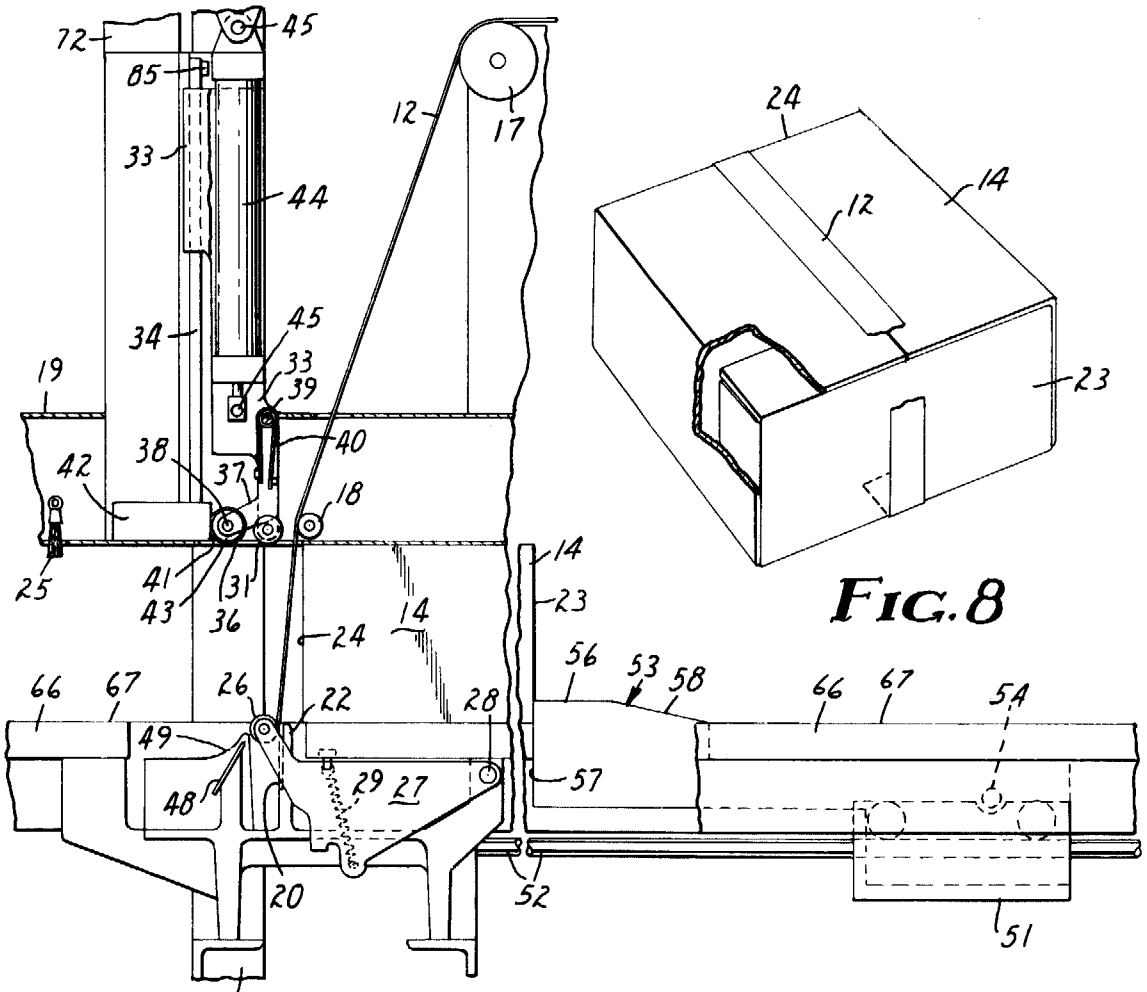
FIG. 3

TAPING DEVICE AND METHOD OF TAPING

BACKGROUND OF THE INVENTION

This invention relates to devices for applying tape and in one aspect to devices for applying lengths of tape to seal boxes propelled through the device.

DESCRIPTION OF THE PRIOR ART

The prior art is replete with devices for applying lengths of tape to objects such as boxes or cartons for purposes of sealing them. U.S. Pat. No. 2,643,016, is specifically noted as it described a type of mechanism which has had wide commercial use in applying tape to seal boxes. Devices built around the mechanism described in U.S. Pat. No. 2,643,016 have at least one disadvantage, however. The device must tape portions of two boxes at the same time. Thus even when the device is used as a taping device for boxes processed in a random time sequence, one partially taped box which could otherwise be shipped must always be left in the device.

SUMMARY OF THE INVENTION

The present invention provides an efficient and simple device for applying predetermined lengths of tape to boxes or cartons which can apply the tape to a single box passed through the device without requiring the presence in the device of a second box to carry out the taping process.

The device can apply the tape completely along three surfaces of the box and firmly adhere the ends of the tape on its fourth surface, thus making it particularly useful for sealing the type of box which in the trade is designated a "one piece folder" and is used extensively in shipping books and phonograph records.

According to the present invention there is provided a device for sealing boxes of the type which have portions which abut or are overlapped so as to provide a meeting line extending longitudinally along one side surface of the carton. The device comprises means defining a box path affording movement of the box endwise in a first direction with its meeting line along a first side of the path. An end portion of the supply length of tape is initially positioned transverse of the path at a first position along the box path between means on the first side of the path adapted for supporting the supply length of the tape from which the tape may be withdrawn against a predetermined tension, and means on a second opposite side of the path adapted for releasably holding a terminal end portion of the tape. The tape is positioned with its adhesive surface facing to engage the leading surface of a box moving in the first direction along the path and is aligned to bridge the meeting line of the box. Means on the device are adapted for propelling a box along the path in the first direction past the first position and to a position with the trailing surface of the box at a second position along the path spaced in the first direction from the first position. During such movement of the box, means press tape being withdrawn from the tape supply into engagement with the box across its meeting line. After the trailing surface of the box reaches the second position means included in the device extend a generally U-shaped length of the tape along the trailing surface of the box. Means in the device press the adjacent portion of the U-shaped length of tape into engagement with the trailing surface of the box, severs apart the extended portions of the U-shaped length of tape at the second side of the path, and engages the newly severed end portion of the supply length of tape with the means for releasably holding a terminal end portion of the tape so that the device is ready to tape another box moved along the path.

BRIEF DESCRIPTION OF THE DRAWING

The present invention will be further described with reference to the accompanying drawing wherein like numbers refer to like parts in the several views, and wherein:

FIGS. 3 through 7 are enlarged fragmentary views partially in section of the device of FIG. 1 which sequentially illustrate the operation thereof; and FIG. 8 is a perspective view of a box which has been taped by the device of FIG. 1 and which has parts broken away to show detail.

DESCRIPTION OF THE PREFERRED EMBODIMENT

Figure 2:
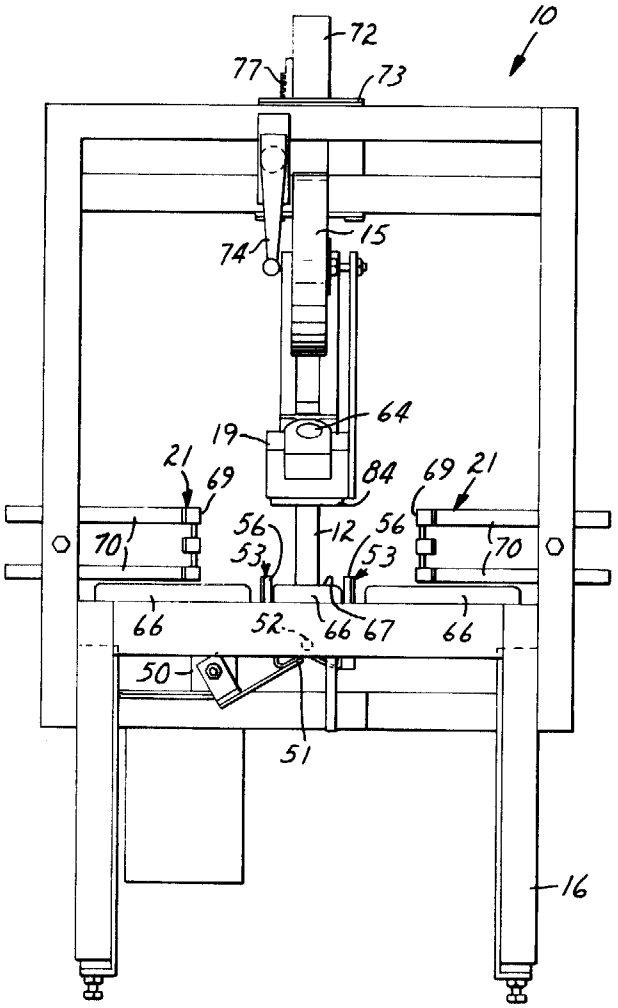
FIG. 2 is a vertical end view of the device of FIG. 1.

Referring now to the drawing there is shown a taping device according to the present invention generally designated by the reference numeral 10.

Figure 1:
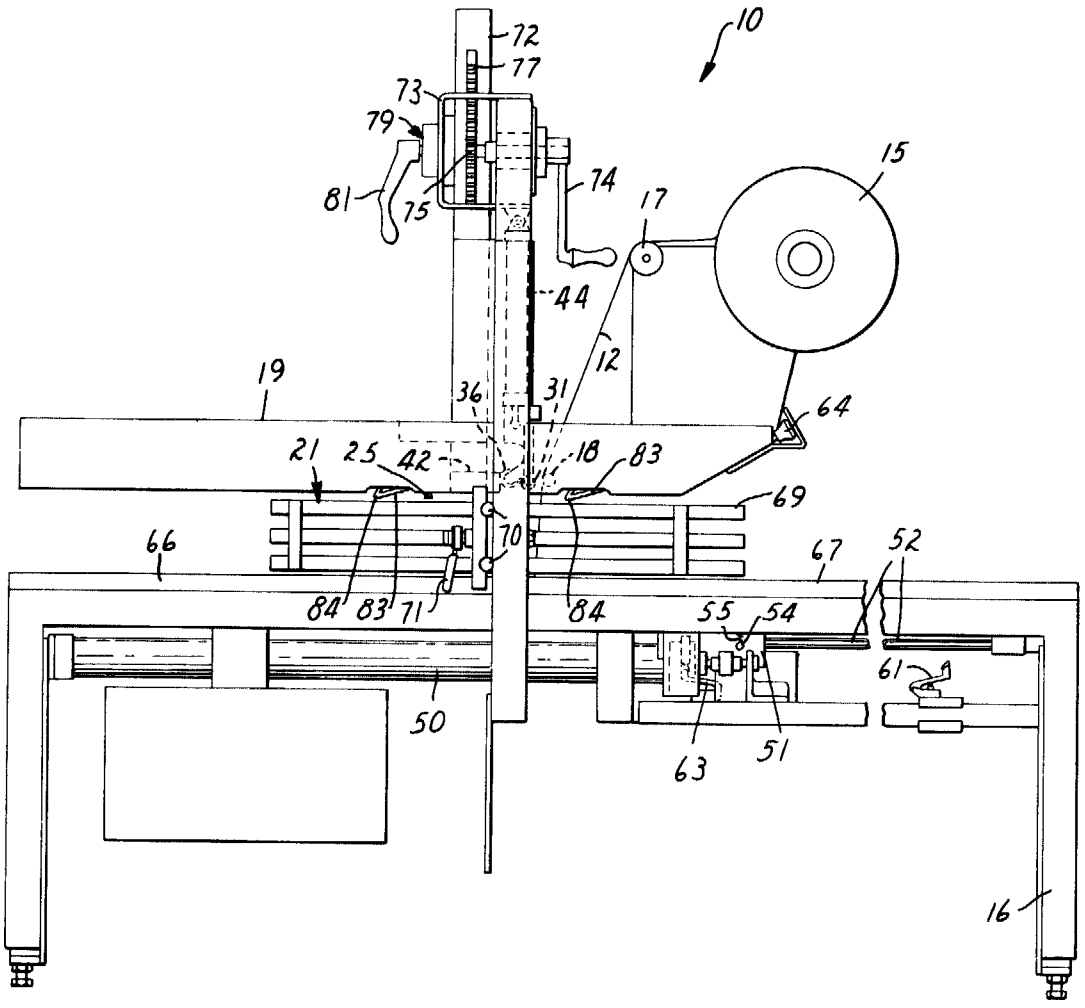
FIG. 1 is a vertical side view of a device according to the present invention for applying predetermined lengths of tape to boxes.

The taping device 10 will be described with reference to the sequence by which it applies a length of a supply length of pressure sensitive adhesive tape 12 to seal shut a box or carton such as the box 14 illustrated. As is seen in FIGS. 1, 2 and 3, in the initial condition of the device 10 the supply length of tape 12 from which the lengths are to be applied extends from a supply roll 15 mounted on a guide frame 19 which is fixed at a predetermined position on a main frame 16 on the device 10, but is movable by means later to be explained to accommodate boxes of various heights. The supply roll 15 is mounted on the guide frame 19 via a friction clutch which restricts overrunning of the supply roll 15. From the supply roll 15 the tape 12 extends along a tape path defined by adhesive contact between the tape 12 and a first guide roller 17 (e.g. of knurled aluminum) rotatably mounted on the guide frame 19 via an adjustable friction clutch to provide means for applying a predetermined amount of tension to the tape 12 as it is applied to a box. From the first guide roller 17 the tape 12 extends with its adhesive surface contacting a second guide roller 18 rotatably mounted on the guide frame 19 on a first side of a path for boxes through the device 10, which box path is adjustably defined between portions of the frame 16 and members adjustably mounted on the frame 16 including the guide frame 19 and a pair of guide shoes 21 as will later be explained. From the second guide roller 18 the tape 12 extends transversely across the box path at a first position along the box path. At a second side of the box path opposite the first side a terminal end portion of the tape 12 is adhered to a surface 20 on a block 22 fixed to the frame 16 with the surface 20 to which the tape is adhered facing in the direction of travel for a box through the device 10 (termed a "first" direction herein). The surface 20 is adapted so that the tape 12 will have only a desired adhesion in peel with the block 22. Such adhesion may be provided by grooving the block 22 to reduce the contact area of the surface 20 (which is required when an aluminum block is used), or by selecting a material for the block 22 such as polyurethane or silicone rubber to which the tape has only the desired adhesion.

A box advancing mechanism, later to be explained, is adapted to propel a box such as the box 14 in the first direction along the box path through the device 10 to position a trailing surface 23 of the box 14 at a second position along the box path, which second position is spaced a predetermined distance along the path in the first direction from the first position. During such movement a leading surface 24 of the box 14 will contact the adhesive surface of the tape 12 extending transverse of the box path causing adhesion therebetween. The second guide roller 18 and block 22 are positioned to slightly incline the transverse length of tape to a direction normal to the box path so that the edge of the box 14 adjacent the guide frame 19 will contact the tape first. Subsequent movement of the box 14 progressively moves the transverse length of tape into engagement across its leading surface 24 so that no wrinkles or loops are formed in the tape 12 as it contacts the box 14. After the tape 12 has contacted the leading surface 24 further movement of the box 14 peels the terminal end portion of the tape away from the surface 20 and pulls tape 12 from the supply roll 15. Such movement of the box 14 along the path moves the length of tape 12 extending between the leading surface 24 of the box 14 and the supply roll 15 first under a tape guide member or tacking roller 31 and another tape guide member or rear pressure roller 36 (which tape guide members 31 and 36 are included in a mechanism for taping the trailing surface of the box 14 later to be explained) and under a brush 25. The rollers 31 and 36 are positioned on the first side of the box path and adjacent the first position to press the tape 12 against the adjacent surface of the box 14 over a meeting line for portions of the box 14 extending longitudinally and aligned along the adjacent side of the box 14 as the box 14 moves adjacent thereto, while the brush 25 provides a final buffing for the applied tape 12.

Such movement of the box 14 also brings the portion of the tape adhered on the leading surface 24 of the box 14 adjacent the block 22 into contact with a front pressure roller 26 initially located in the path for the box 14. The front pressure roller 26 is rotatably mounted on a bracket 27 pivotably mounted on the frame 16 at a pin 28. The pin 28 and bracket 27 are oriented so that movement of the box 14 subsequent to such contact will cause the front pressure roller 26 to move from its position in the box path around the corner of the box 14 against the bias of a spring 29 between the frame 16 and bracket 27 (FIG. 4). Thus the front pressure roller 26 will roll along and press the end portion of the tape 12 against the surface of the box 14 adjacent the block 22 under the influence of the spring 29 as that end portion of the tape 12 is peeled from the block 22 by movement of the box 14.

Figure 5:
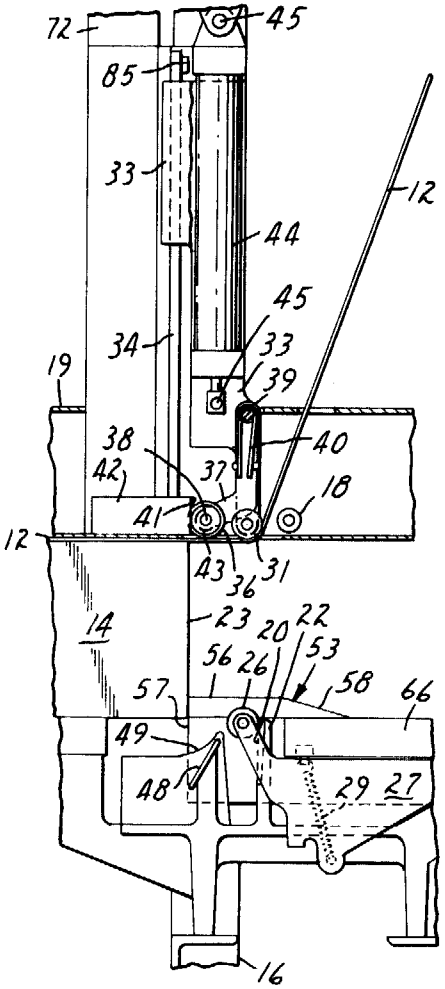
Figure 6:
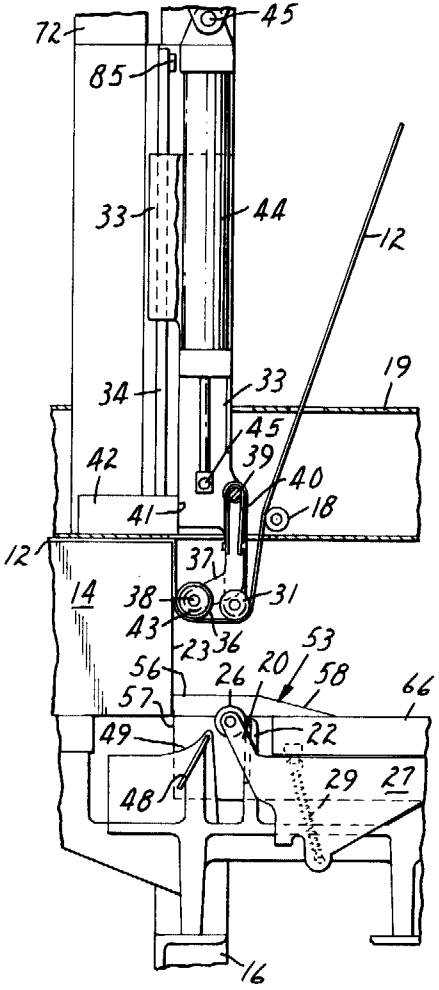
Figure 7:
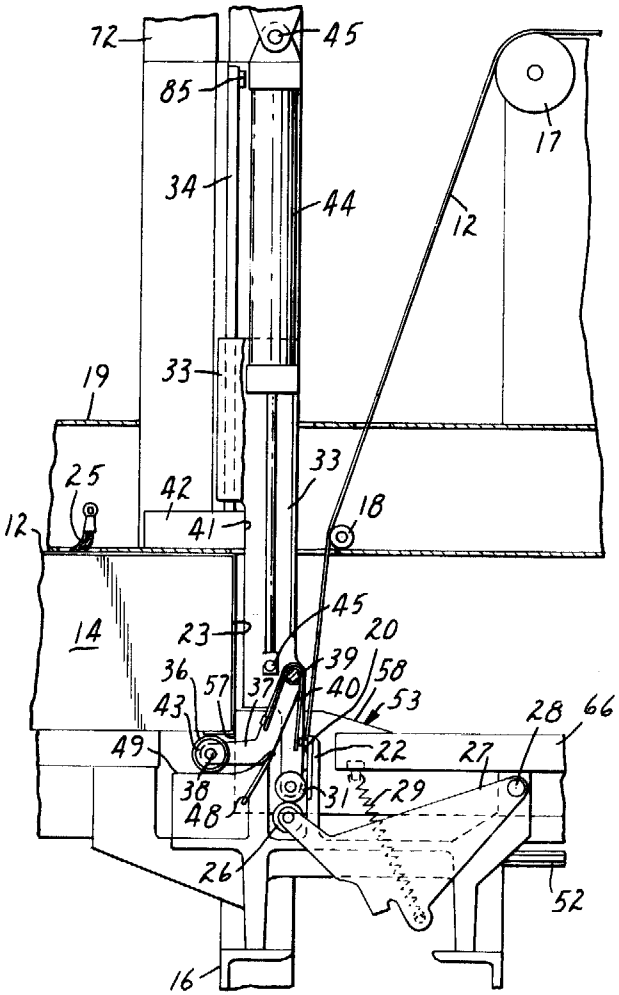

FIGS. 5, 6 and 7 illustrate the box 14 with its trailing surface 23 at the second position along the box path. When the trailing surface 23 of the box 14 first reaches that second position (FIG. 5) the trailing surface 23 has passed the second guide roller 18 and the tape 12 extends past the trailing surface 23 between the box 14 and the tacking roller 31 and adjacent the periphery of the rear pressure roller 36. The tacking roller 31 is rotatably mounted on an arm 33 slidably mounted on a rectangular bar 34 fixed to the frame 19 for movement between a poised position with the tacking roller 31 on the first side of the path (FIG. 5) and an extended position with the tacking roller 31 on the second side of the path and along the surface 20 of the block 22 (FIG. 7). The rear pressure roller 36, which is axially parallel with the tacking roller 31, is rotatably mounted on a shaft 38 at on end of an L-spaped bracket 37. The bracket 37 has its other end pivotably mounted at a pin 39 on the movable arm 33. A wire spring 40 provides means for biasing the third pressure roller 36 toward an extended or contact position spaced in the first direction away from the tacking roller 31. When the arm 33 is in its poised position illustrated in FIGS. 3, 4 and 5, however, the rear pressure roller 36 will be held in a retracted position more closely spaced in the first direction from the tacking roller 31 by an edge surface 41 of a cam plate 42 mounted to the guide frame 19 which cam plate 42 engages a collar 43 on the shaft 38 beside the rear pressure roller 36. When the trailing surface 23 of the box 14 reaches said second position along the box path, an air cylinder 44 coupled between the frame 16 and the arm 33 at pivot pins 45 is activated to slide the arm 33 along the bar 34, and thereby move the rear pressure roller 36 with the tacking roller 31, transverse of the box path from the poised position (FIGS. 1 and 2) to the extended position (FIG. 7). During such movement (FIG. 6) the rear pressure roller 36 and the tacking roller 31 will extend a U-shaped length of the tape 12 along the trailing surface 23 of the box 14, while the rear pressure roller 36, released from the cam plate 42, will be biased by the spring 40 against the portion of the U-shaped length of tape 12 extending along the trailing surface 23 of the box 14, causing that length of tape to be adhered thereto. As the rear pressure roller 36 and the tacking roller 31 approach their extended positions, a knife 48 fixed to the main frame 16 will engage and sever the length of tape extending therebetween. Upon subsequent movement of the rear pressure roller 36 to its extended position, it will follow the newly severed terminal length of the tape 12 applied to the box 14 and will follow around the edge of the box 14 under the influence of the spring 40 and engagement of a cam surface 49 on the frame 16 with the collar 43 adjacent the rear pressure roller 36 (which precludes bouncing of the rear pressure roller 36) to attach the end of the tape to the surface of the box 14 along the second side of the box path (See FIG. 7). Simultaneously, the tacking roller 31 will press the newly severed end of the supply length of tape 12 along the contact surface 20 of the block 22 while moving the pressure roller 26 away from its first position against the bias of the spring 29. Subsequently, while the trailing surface 23 of the box 14 is still at the second position along the path the control system activates the air cylinder 44 to return the tacking roller 31 and the rear pressure roller 36 to their poised position. This allows the rear pressure roller 36 to again move along the applied tape on the trailing surface 23 of the box 14 and the collar 43 to again engage the edge surface 41 of the cam plate 42, and moves the tacking roller 31 off of the contact surface 20 which allows the front pressure roller 26 to return to its position in the box path under the influence of the spring 29. The operator can now remove the taped box 14 from the device 10 and the device 10 is ready to apply a length of tape to a new box inserted therein.

The box advancing mechanism is of a known design which is adapted for engaging a box manually positioned at any position along a predetermined length of the box path, and for then propelling the trailing surface of that box to the predetermined second position along the box path.

As is best seen in FIGS. 1, 2 and 3, the box advancing mechanism comprises a carriage 51 slidably mounted on a hexagonal rod 52 fixed to the frame 16 for movement along the second side of and parallel to the box path. Two parallel pusher bars 53 (FIG. 3) are pivotably mounted at one end on a pin 54 fixed to the carriage 51 and are biased by a spring 55 to a position against a stop (not shown) at which end portions 56 of the pusher bars 53 opposite the pin 54 project into the box path. Contact surfaces 57 of the projecting end portions 56 opposite the pin 54 are disposed generally normal to the direction of travel of a box along the path and are adapted to engage the trailing surface 23 of a box 14 to transfer a driving force thereto as the carriage 51 and pusher bars 53 are driven in the direction of travel of boxes through the device 10 (first direction). The projecting portions 56 of the pusher bars 53 adjacent the pin 54 are tapered out of the path for the box, and define cam surfaces 58. The cam surfaces 58 are adapted to engage the adjacent leading edge of a box along the path and move the projecting portions 56 of the pusher bars 53 out of the path for the boxes against the bias of the spring 55 and allow them to move around a box along the path when the carriage 51 and the pusher bars 53 mounted thereon move in a direction opposite the first direction. An air cylinder 50, manually activatable via a start button 64, provides means for reciprocally moving the carriage 51 between an inner position determined by engagement of the carriage 51 with a first air limit switch 63 at which the end surfaces 57 of the pusher bars 53 are at the second position along the path, an outer position determined by engagement of the carriage 51 with a second air limit switch 61 at which the contact surfaces 57 are spaced a predetermined distance from the tape 12 extending transverse of the box path which affords ease of insertion of a box therebetween; and back to the inner position.

A user places a box along the box path on the frame 16 within the predetermined distance in advance of the length of tape 12 extending across the box path. He then presses the start button 64 which activates the air cylinder 50 and moves the pusher bars 53 from their inner to their outer positions during which movement the projecting portions 56 move around the box via the camming action of the cam surfaces 58. The pusher bars 53 then return to their inner position during which movement the contact surfaces 57 of the projecting portions 56 contact the trailing surface of the box and move the box into engagement with the tape 12 transverse of the path and move the trailing surface of the box to the predetermined second position at which the air cylinder 44 will be activated to apply the tape to the trailing surface of the box.

The means for defining the path for the box through the device 10 includes three longitudinal members 66 included in the frame 16 which define a support surface 67 along which the box is slid through the device 10. Also included are the two guide shoes 21 which have opposed planar guide surfaces 69 which guide opposite side surfaces of a box moving along the path. The shoes 21 include support bars 70 which project at right angles to the side guide surfaces 69. The support bars 70 are releasably clamped to the frame 16 via clamp assemblies including a manually operable clamp handle 71 to afford repositioning the guide shoes 21 to accommodate boxes of different widths. The guide frame 19 on which the first and second guide rollers 17 and 18 are mounted has a vertically extending beam 72 slidably mounted through a U-shaped portion 73 of the frame 16. The guide frame 19 may be moved relative to the support surface 67 to accommodate boxes of different heights via manual manipulation of a crank 74 fixed to a shaft 76 rotatably mounted on the frame 16 and to which shaft 76 is fixed a gear 75 engaged with a rack 77 fixed to the beam 72 of the guide frame 19. Between adjustments the guide frame 19 is clamped in place by a clamp assembly 79 positioned between the frame 16 and the beam 72 and manually engaged or released by a clamp lever 81.

The means for defining the box path also include two pressure feet 83 pivotally mounted on the guide frame 19 and spring biased to press edges 84 of the feet into engagement with a box along the path. The pressure feet 83 provide a regulated amount of force restricting movement of a box along the path so that the box will not be moved by movement of the pusher bars 53 under the box during its cycle, or by the pressure of the rear pressure roller 36 moving along the trailing surface 23 of the box.

The device also includes means for restricting the movement of the arm from its poised to its extended position between limits properly corresponding to the spacing between the support surface 67 and the guide frame 19. The bar 34, which is fixed to the guide frame 19, carries a fixed stop 85 engaged by the arm 33 to define its poised position relative to the heights of boxes being taped, whereas the length of stroke of the cylinder 44 (which cylinder 44 is fixed to the frame 16) determines the extended position for the rear pressure roller 36 and tacking roller 31 and insures that their extended position is always the same relative to the knife 48 and block 22 regardless of the position of the guide frame 19.

We claim:

1. A method for applying a length of tape coated on one side with pressure sensitive adhesive from a supply length of the tape to a box along a meeting line defined by adjacent portions of the box and extending longitudinally along one side surface of the box, said method comprising:

defining a box path adapted to affort movement of the box endwise in a first direction with the meeting line of the box along a first side of the path;

positioning an end portion of the supply length of tape transverse of the path at a first position along the box path between means on the first side of the box path for supporting the supply length of the tape from which the tape may be withdrawn against a predetermined tension and means on the opposite side of the box path for releasably holding a terminal end portion of the tape, the tape being positioned with its adhesive surface facing to engage the leading surface of the box moving in the first direction along the path and to bridge the meeting line of the box;

propelling the box along the path in the first direction past the first position and to a position with the trailing surface of the box at a predetermined second position along the box path, the second position being spaced in the first direction from the first position;

pressing the tape being withdrawn from the tape supply into engagement with the box over the meeting line adjacent the first position upon movement of the box past the second position;

providing an assembly including an arm, a first tape guide member, means mounting the first tape guide member on the arm for movement between a retracted position adjacent the arm and an extended position spaced from the arm, means for biasing the first guide member toward its extended position, and a second tape guide member mounted on the arm in spaced relationship with the first guide member;

moving the arm assembly transversely across the path after the trailing surface of the box reaches the second position with the tape guided around the first and second tape guide members to extend a generally U-shaped length of the tape along the trailing surface of the box, and with the first tape guide member biased against the trailing surface to bias tape around the first tape guide member into engagement therewith and with the surface of the box along the second side of the path;

severing the tape between the first and second tape guide members at the second side of the path; and engaging the newly severed end portion of the supply length of tape extending around the second guide member with the means for releasably holding a terminal end portion of the tape by movement of the second guide member adjacent to the means for releasably holding.

2. A device for applying a length of tape coated on one side with pressure sensitive adhesive from a supply length of the tape along a meeting line defined by adjacent portions of a box and extending between opposite end surfaces along one side surface of the box, said device comprising:

means defining a box path adapted to afford movement of a said box endwise in a first direction with the meeting line of the box along a first side of the path;

tape positioning means adapted for positioning an end portion of the supply length of tape transverse of the path at a first position along the box path, said tape positioning means comprising means on said first side of the path adapted for supporting the supply length of the tape from which the tape may be withdrawn against a predetermined tension and means on a second side of the path opposite said first side adapted for releasably holding a terminal end portion of the tape, said tape positioning means positioning the tape with its adhesive surface facing to engage the leading end surface of a said box moving in the first direction along the path and aligned to bridge the meeting line of the box;

means adapted for propelling a said box along the path in the first direction past said first position and to a position with the trailing end surface of the box at a second position along the path, said second position being spaced in said first direction from said first position;

means adjacent said first position along the path adapted for pressing tape being withdrawn from the tape supply into engagement with a said box over its meeting line upon movement of the box past the second position;

means adapted for applying tape to the trailing surface of a said box and the surface of the box along the second side of said path after the trailing surface of the box reaches said second position, comprising:

an arm;

means mounting said arm for movement between a poised position on said first side of said box path and an extended position transverse of said box path;

means on said arm adapted for guiding said tape to extend a generally U-shaped length of said tape along the trailing surface of the box upon movement of said arm from said poised position to said extended position and for pressing the portion of the U-shaped length of tape adjacent the trailing surface of the box into engagement therewith and with the surface of the box along the second side of said path, including:

a first tape guide member;

means mounting said first tape guide member on said arm for movement between a retracted position adjacent said arm and an extended position spaced from said arm in said first direction; and means for biasing said first guide member toward said extended position; and means for severing the tape being applied from the supply length of tape and for engaging the newly severed end of the supply length of tape with said means for releasably holding a terminal end portion of the tape, comprising:

a second tape guide member mounted on said arm in spaced relationship with said first guide member for movement with said arm transverse of said box path approximately at said first position, said second tape guide member being on said first side of said path when said arm is in said poised position and on said second side of said path in a position to engage tape extending around said second guide member with said means for releasably holding when said arm is in said extended position; and a knife on the second side of said path adapted to sever said tape between said guide members during movement of said arm to said extended position.

3. A device according to claim 2, wherein said first tape guide member is a roller and said means for mounting said first tape guide member on said arm comprises a generally L-shaped bracket rotatably supporting said roller at one end, said bracket being pivotably mounted on said arm at its end opposite said roller in a position to afford movement of said one roller first along the trailing surface of the box and then along the surface of the box adjacent the second side of the box path under the influence of said biasing means during movement of said arm to its extended position.

4. A device according to claim 2, wherein said second tape guide member is a roller rotatably mounted on said arm, said means adapted for releasably holding a terminal end portion of the tape is a block having a surface adapted to be adhered to by the terminal end portion of the tape, and said roller presses the newly severed end of the supply length of tape against the surface of said block during movement of said arm to its extended position.

* * * * *